US011398320B2

(12) United States Patent
Kloehn et al.

(10) Patent No.: US 11,398,320 B2
(45) Date of Patent: Jul. 26, 2022

(54) CONTAINER FOR RADIOACTIVE WASTE COMPRISING L-SHAPED GROOVES FOR FIXEDLY CONNECTING COVER WITHOUT WELDS

(71) Applicants: Berthold Kloehn, Witten (DE); Roland Hueggenberg, Bochum (DE)

(72) Inventors: Berthold Kloehn, Witten (DE); Roland Hueggenberg, Bochum (DE)

(73) Assignee: GNS GESELLSCHAFT FUER NUKLEAR-SERVICES MBH, Essen (DE)

( * ) Notice: Subject to any disclaimer, the term of this patent is extended or adjusted under 35 U.S.C. 154(b) by 471 days.

(21) Appl. No.: 16/439,814

(22) Filed: Jun. 13, 2019

(65) Prior Publication Data

US 2020/0161013 A1 May 21, 2020

(30) Foreign Application Priority Data

Jun. 15, 2018 (EP) ..... 18178093

(51) Int. Cl.
*G21F 5/12* (2006.01)
*G21F 5/012* (2006.01)
*G21F 5/008* (2006.01)

(52) U.S. Cl.
CPC ..... *G21F 5/12* (2013.01); *G21F 5/008* (2013.01); *G21F 5/012* (2013.01)

(58) Field of Classification Search
CPC . G21F 5/012; G21F 5/12; G21F 5/008; G21F 5/00; G21F 5/06; G21F 5/065; B65D 43/02; B65D 43/00; B65D 43/021; B65D 43/0212; B65D 43/0225; B65D 43/0229; B65D 43/0281; B65D 43/0283; B65D 53/02; B65D 53/022; B65D 2590/0058; G21C 19/32; G21C 19/00; G21C 19/06; G21C 19/07; G21C 19/10; G21C 19/105; G21C 19/11; G21C 19/115
USPC ..... 376/272, 456, 457
See application file for complete search history.

(56) References Cited

U.S. PATENT DOCUMENTS 4,445,042 A * 4/1984 Baatz ..... G21F 5/12 250/506.1
5,615,794 A * 4/1997 Murray, Jr. ..... G21F 5/12 220/304
2012/0099693 A1* 4/2012 Hempy ..... G21F 5/008 376/272

* cited by examiner

*Primary Examiner* — Darlene M Ritchie
(74) *Attorney, Agent, or Firm* — Andrew Wilford

(57) ABSTRACT

A container for holding radioactive waste has a side wall, a floor connected to a lower end of the side wall, and a cover. A set of side-wall formations is provided at an upper end of the side wall and on an inner surface of the side wall, and a set of cover-edge formations is distributed around an outer edge of the cover and fittable with the side-wall formations. Thus, as a result of the interfitting of cover-edge formations with the side-wall formations, the cover can be or is fixedly connected to the side wall without welds.

15 Claims, 3 Drawing Sheets

CONTAINER FOR RADIOACTIVE WASTE COMPRISING L-SHAPED GROOVES FOR FIXEDLY CONNECTING COVER WITHOUT WELDS

FIELD OF THE INVENTION

The present invention relates to a container. More particularly this invention concerns a container for holding and transporting radioactive waste such as spent fuel rods.

BACKGROUND OF THE INVENTION

A container for holding radioactive waste, particularly for holding spent fuel elements, typically has a side wall, a floor connected to the side wall, and at least one cover. The invention further relates to a container assembly of a canister and a transport and/or storage container.

Containers of the above-described type are known from practice in diverse variants. For instance, canisters for the transfer of spent fuel elements are known in particular. These canisters are loaded under water with the spent fuel elements and then sealed with a cover. These sealed canisters are then transferred to a transport and/or storage container. Due to the vertical handling of a canister upon insertion into the transport and/or storage container, the load attachment point must be on the upper side of the canister cover and be designed to be loaded by the canister mass, fuel element support basket, and fuel elements. For this reason, a multilayer, massive force-transmitting weld is provided between the cover and side wall of the canister as a load-bearing component of such a canister. In addition, a weld ring is also provided as a seal weld. The production and reproducibility of welds must be ensured by an appropriate inspection. Different national regulations exist for this purpose. In countries in which the canisters cannot be used for interim storage or permanent storage, the welds on the canisters must be ultimately reopened and the fuel elements transferred. As a result, the effort and expense associated with the measures described are substantial.

Furthermore, it is known to provide transport and/or storage containers first with a primary cover and then with a secondary cover. After loading a container, the primary cover is fixed in place by screws with interposition of metal gaskets. The screws must dissipate the inertial forces acting on the cover that are caused by the mass of the cover, the mass of the support basket, and the mass of the fuel elements. In order to ensure the sealing and compression of the metal gaskets, elastic loading of the screws is required, and the screws are subjected to bending stress in addition to the purely tensile load. Due to the high loaded masses and accelerations, a relatively large number of cover screws is required. The number of cover screws is structurally limited due to the installation space required for the screw heads, so the load-bearing cross section of the screws is limited. It will readily be understood that, as the number of screws increases, the effort and expense involved in servicing increases. The known measures have inherently proven their worth. Nevertheless, they are relatively costly.

OBJECTS OF THE INVENTION

It is therefore an object of the present invention to provide an improved container for holding radioactive waste.

Another object is the provision of such an improved container for holding radioactive waste that overcomes the above-given disadvantages, in particular that enables the container to be sealed in a simple and inexpensive manner while nonetheless providing an optimal sealing function.

Another object of the invention is to provide a corresponding container assembly.

SUMMARY OF THE INVENTION

A container for holding radioactive waste has according to the invention a side wall, a floor connected to a lower end of the side wall, and a cover. A set of side-wall formations is provided at an upper end of the side wall and on an inner surface of the side wall, and a set of cover-edge formations is distributed around an outer edge of the cover and fittable with the side-wall formations. Thus, as a result of the interfitting of cover-edge formations with the side-wall formations, the cover can be or is fixedly connected to the side wall without welds.

It therefore lies within the scope of the invention for the cover to be fixedly connected to the formations of the side wall as a result of the interfitting of its complementary formations when the container is in the closed state. It also lies within the scope of the invention for a support basket for holding spent fuel elements to be in the interior of the container according to the invention. Advantageously, the floor and the side wall are integrally connected to one another. According to another alternative of the invention, the floor and the side wall of the container are interconnected by at least one weld.

According to a very preferred embodiment of the invention, the container according to the invention is a canister loaded with the fuel elements and is then introduced into a transport and/or storage container. As a rule, the canister is loaded with the fuel elements under water and sealed with the cover. The canister is then transferred by a transfer container to the transport and/or storage container and introduced there into the transport and/or storage container. According to another embodiment of the invention, the container is a transport and/or storage container and the cover is then the primary cover of the transport and/or storage container, the primary cover being equipped with the complementary formations.

According to the invention, a form-fitting connection is established between the cover and the side wall, particularly without welds. At the same time, it lies within the scope of the invention for the cover to be moved from an open position into a locking position through rotation. Advantageously, the rotation can also be reversed from the locking position to the open position. Accordingly, the container can also be easily opened again. It is recommended that the rotation of the cover from the open position to the locked position and vice versa occur over the smallest possible angle.

In order to achieve the form-fitting connection between the cover and the side wall, at least three, at least four, more at least five, and very at least six formations are advantageously distributed in the interior of the container around the inner surface of the side wall. One especially recommended embodiment of the invention is characterized in that at least eight, advantageously at least ten, and at least twelve formations are in the interior of the container so as to be distributed around the inner surface of the side wall. Advantageously, at least three, at least four, more at least five, and very at least six complementary formations are distributed around the outer edge of the cover. It is especially preferred in the context of the invention for at least eight, at least ten, and especially at least twelve complementary formations to be provided in such a manner as to be distributed around the outer edge of the cover. It lies within the scope of the invention for the number of formations on the inner surface of the side wall to correspond to the number of complementary formations on the outer edge of the cover.

One very preferred embodiment of the invention is characterized in that the side-wall formations and/or the complementary cover-edge formations are formed as bumps, more particularly as projections. These projections can either be welded on or machined from the corresponding container material. It is advantageous for either the side-wall formations or the complementary cover-edge formations to be projections. It has been found to be advantageous in the context of the invention if the formations that are distributed in the interior of the container around the inner surface thereof are bumps, more particularly projections. The projections are then either welded to the upper cover-side edge region of the side wall or machined from the side wall material. It is recommended that the projections have a rectangular or substantially rectangular shape when viewed from above. According to a design variant, the projections are rectangular in shape with rounded corners. It lies within the scope of the invention if such a projection can be fitted positively in a groove described below and, particularly, in a portion of such a groove.

One especially recommended embodiment of the invention is characterized in that the side-wall formations and/or the complementary cover-edge formations are formed as grooves. It is advantageous for either the side-wall formations or the complementary cover-edge formations to be grooves. It has been found to be advantageous in the context of the invention if the complementary formations that are distributed around the outer edge of the cover are grooves. A preferred embodiment is characterized in that a groove has at least two groove portions that extend perpendicular or substantially perpendicular to one another. Advantageously, at least one groove or one portion of each groove is parallel or substantially parallel to the longitudinal axis L of the container, and at least one additional groove or one additional groove portion is perpendicular or substantially perpendicular to the longitudinal axis L of the container. An L-shaped or substantially L-shaped configuration of the grooves is especially preferred in the context of the invention. One groove portion is advantageously oriented parallel or substantially parallel to the container axis L, and the other groove portion is perpendicular or substantially perpendicular to the axis L of the container. It is especially recommended in the context of the invention that a groove or a groove portion be a tangential. "Tangential groove portion" refers here to a groove portion that, given a cover having a round or circular cross section, would form a tangent or approximately a tangent in relation to the round or circular cover if it were extended. Advantageously, the groove portion oriented perpendicular or substantially perpendicular to the longitudinal axis L of the container is a tangential groove portion.

Incidentally, the expressions "perpendicular to the longitudinal axis L of the container" and "parallel to the longitudinal axis L of the container" refer particularly to the locking position of the container with cover already inserted. It is recommended that the groove portion parallel to the longitudinal axis L of the container be open toward the underside of the cover, so that as described below these groove portions can be pushed onto the projections projecting from the interior of the side wall. Preferably, both the groove portion oriented parallel to the longitudinal axis L of the container and the L-portion oriented perpendicular to the longitudinal axis L of the container are upwardly closed, in which case a groove abutment edge or groove abutment surface is realized on the upper side of the cover.

A recommended embodiment of the invention is characterized in that a plurality of complementary formations in the form of grooves, at least eight, more at least ten, and very at least twelve grooves, are distributed around the outer edge of the cover. It is recommended that in this embodiment the side wall have a plurality of formations in the form of projections, particularly in the form of rectangular projections, that are distributed around its inner surface. Advantageously, at least eight, at least ten, and more at least twelve formations or projections are provided on the inner surface of the side wall. It lies within the scope of the invention for the number of formations on the side wall to correspond to the number of complementary formations on the cover. Advantageously, the formations on the inner surface of the side wall are distributed uniformly around the inner surface of the side wall, specifically at equal or substantially equal distances from one another. It is recommended that the complementary formations that are provided on the outer edge of the cover be distributed uniformly around the outer edge of the cover, specifically and at equal or substantially equal distances from one another.

It was already noted that the complementary formations that are distributed around the outer edge of the cover have L-shaped grooves and that, advantageously, the groove portion is oriented parallel to the longitudinal axis L of the container, it being recommended that this groove portion be open toward the underside of the container. In order to seal the container with the cover, the cover is inserted into the side wall with the understanding that the grooves that are distributed around the outer edge of the cover, particularly the groove portions that are distributed around the outer edge of the cover and oriented so as to be parallel to the longitudinal axis L of the container, are each pushed onto a projection provided in the interior of the container. Each of the projections comes to rest against the upper-side groove abutment edge or groove abutment surface of the parallel groove portions of the cover. When the cover is twisted, each of the projections that are present on the inner surface of the side wall then comes into engagement with the groove portion perpendicular to the longitudinal axis L of the container. When the webs are in engagement with, more particularly in full engagement with this latter groove portion, the cover is in its locking position. Preferably, the number of formations and complementary formations is selected such that the torsion angle during the movement of the cover from the opening position to the locking position is as small as possible and less than 25°, more less than 20°, and very less than 15°.

It lies within the scope of the invention for the projections, particularly the projections on the inner surface of the side wall, to abut against a groove abutment edge or groove abutment surface of a groove, of an L-shaped groove, on the upper side of the container. The cover is supported in the axial direction or in the direction of the longitudinal axis L of the container of the container in a functionally reliable manner on the container, thus enabling a load attachment point to be effectively realized on the cover. It is recommended that the groove abutment edges or groove abutment surfaces be provided on both groove portions of the L-shaped grooves.

One highly recommended embodiment of the invention is characterized in that the grooves, the grooves on the outer edge of the cover, each have at least one groove region whose groove base on the bottom side of the container is angled toward the interior of the container and the bottom of the container. It is recommended that, in the case of L-shaped grooves, at least the groove portion oriented so as to be perpendicular to the longitudinal axis L of the container has a groove lower face on the bottom side of the container angled toward the interior of the container and the floor. It lies within the scope of the invention for the projections on the inner surface of the side wall to have complementary angles. This configuration with the inclined surfaces ensures that, if the container or the cover is lifted when in the locking position, the forces acting radially on the side wall can be reduced, thus preventing spreading of the side wall.

According to the invention, a form-fitting connection occurs between the cover and side wall. It lies within the scope of the invention for sealing measures for a functionally reliable seal between the cover and side wall to be additionally implemented. A preferred embodiment of the invention is characterized in that, when the container is in the locking position, at least one sealing groove that runs around the periphery of the container is provided on the upper side of the container between the cover and the side wall. It is recommended that the sealing groove be between the upper edge of the side wall and the outer edge of the cover, the cover, more particularly the outer edge of the cover, having a recess on the upper side. It has proven advantageous if the lower face of this recess is frustoconically angled toward the side wall. Advantageously, at least one seal, more particularly at least one sealing ring, is fitted in or inserted into the sealing groove. It lies within the scope of the invention for the at least one seal to extend annularly around the periphery of the container.

It is recommended that the at least one seal, more particularly at least one seal ring, be a metal gasket and/or an elastomer seal. In the context of the embodiment in which the container is a canister that can be transferred to a transport and/or storage container, at least one elastomer seal can first be inserted into the sealing groove after the canister is loaded with the fuel elements under water. During further handling, the elastomer seal can be removed, and then at least one metal gasket can be advantageously used for the seal between cover and side wall. If the cover is a primary cover of a transport and/or storage container, at least one metal gasket is used as a seal.

According to an especially recommended embodiment of the invention, a metal gasket used in the context the invention has a core ring made of at least one metal and at least one jacket enclosing the core ring made of at least one metal. Advantageously, such a metal gasket or such a metal sealing ring is provided with a core ring made of at least one metal, a nickel alloy or a nickel-based alloy, and with an inner jacket made of at least one metal and at least one outer jacket mounted thereon made of at least one metal. The inner jacket is advantageously made of steel and of stainless steel. One embodiment of the invention is characterized in that the outer jacket consists or substantially consists of a metal from the group aluminum, silver, gold. Such a metal seal or such a metal sealing ring has proven to be very especially useful in combination with the form-fitting measures according to the invention.

It lies within the scope of the invention for at least one compression element, particularly at least one compression ring to be placed onto the cover when the container is in the locked state or in the locking position. Advantageously, the compression element or the compression ring compresses the at least one seal in the sealing groove. This compression results in an outstanding sealing function. According to a preferred design variant of the invention, the compression element or the compression ring is fixed in place by screwing to the container, particularly to the cover. Advantageously, the compression element or the compression ring runs around the periphery of the container or cover. According to the recommended embodiment of the invention, the compression element or the compression ring has a ridge on the cover side of the container that engages in the sealing groove in order to compress the seal. It lies within the scope of the invention for this ridge to run around the periphery of the container. Recommendably, the ridge has a frustoconical lower face angled upward and toward the side wall. With the angled face provided on the groove-type recess base of the groove-type recess or sealing groove, this angling enables an especially effective compression of the seal and hence a very functionally reliable radial seal between cover and side wall to be achieved.

The invention also relates to a container assembly comprising a container according to the invention, the container being a canister loaded with spent fuel elements and received in a transport and/or storage container that can be or is sealed with at least one primary cover and can be or is advantageously additionally sealed with at least one secondary cover fitted over the primary cover. The canister is advantageously loaded under water with the spent fuel elements, the fuel assemblies being received by a support basket in the canister. The canister is then transferred by a transfer container to the transport and/or storage container and introduced there into the transport and/or storage container. The transport and/or storage container is then sealed with the primary cover and the secondary cover and fed to interim or permanent storage.

According to another embodiment of the invention, the container according to the invention is already a transport and/or storage container, in which case the cover is the primary cover of the transport and/or storage container. Advantageously, the primary cover is fixed in a form-fitting manner to the side wall of the transport and/or storage container by the measures according to the invention. After the form-fitting positioning of the primary cover, the transport and/or storage container is advantageously sealed by an additional secondary cover. The secondary cover is fixed to the container by screws.

The invention is based on the discovery that the container according to the invention can be sealed in a simple, inexpensive, and functionally reliable manner by the form-fitting measures according to the invention without welds. If the container according to the invention is a canister for transferring the spent fuel elements, a simple closure mechanism can be realized without a load-bearing weld that nevertheless easily ensures optimal bearing capacity of the canister during the corresponding manipulations. The cover provides an effective load attachment point even with larger masses to be transported and under greater loads. Due to the lack of a load-bearing weld, a costly country-specific process qualification of the welding process by experts is unnecessary. It should be emphasized that the container or the canister can be easily sealed and also reopened without any difficulty. In principle, any closing and opening of the container is readily possible. This is advantageous particularly if the canister is not intended for interim storage or permanent storage. The inventively designed cover can still be used without restriction when loading a canister under water. In fact, production is simplified, production time is shortened, and the risk during production is reduced. It should also be emphasized that, in comparison to the conventional canisters for the implementation of the measures according to the invention, no substantial alterations of the canister body are required.

If the container is a transport and/or storage container and the cover is the primary cover of this container, elaborate and time-consuming screw attachment of the primary cover using cover screws can be dispensed with. Thus, no dissipation of inertial forces via cover screws is required. The load-bearing cross sections can be increased substantially when implementing the measures according to the invention as opposed to screws. Apart from that, the outer diameter of the primary cover, and hence the outer diameter of the secondary cover as well, can be reduced. This has the advantage that a larger residual wall thickness of the container body or side wall in the cover region is possible. This increases stability, among other things, in the event of a lateral impact to the container.

The use of a seal in the groove between cover and side wall is also especially advantageous in a container according to the invention. It is possible here to replace the seal without disassembling the cover. The compression state of the seal is advantageously independent of the locking of the cover. By virtue of the radial seal in the measures according to the invention, no impairment of tightness occurs as a result of transverse displacements.

As a result, the measures according to the invention provide an alternative canister closure or container closure that on the one hand offers the same advantages as the closures known hitherto from the prior art, in particular, mechanical stability and leak-tightness, but on the other hand has additional substantial advantages over them.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1A:
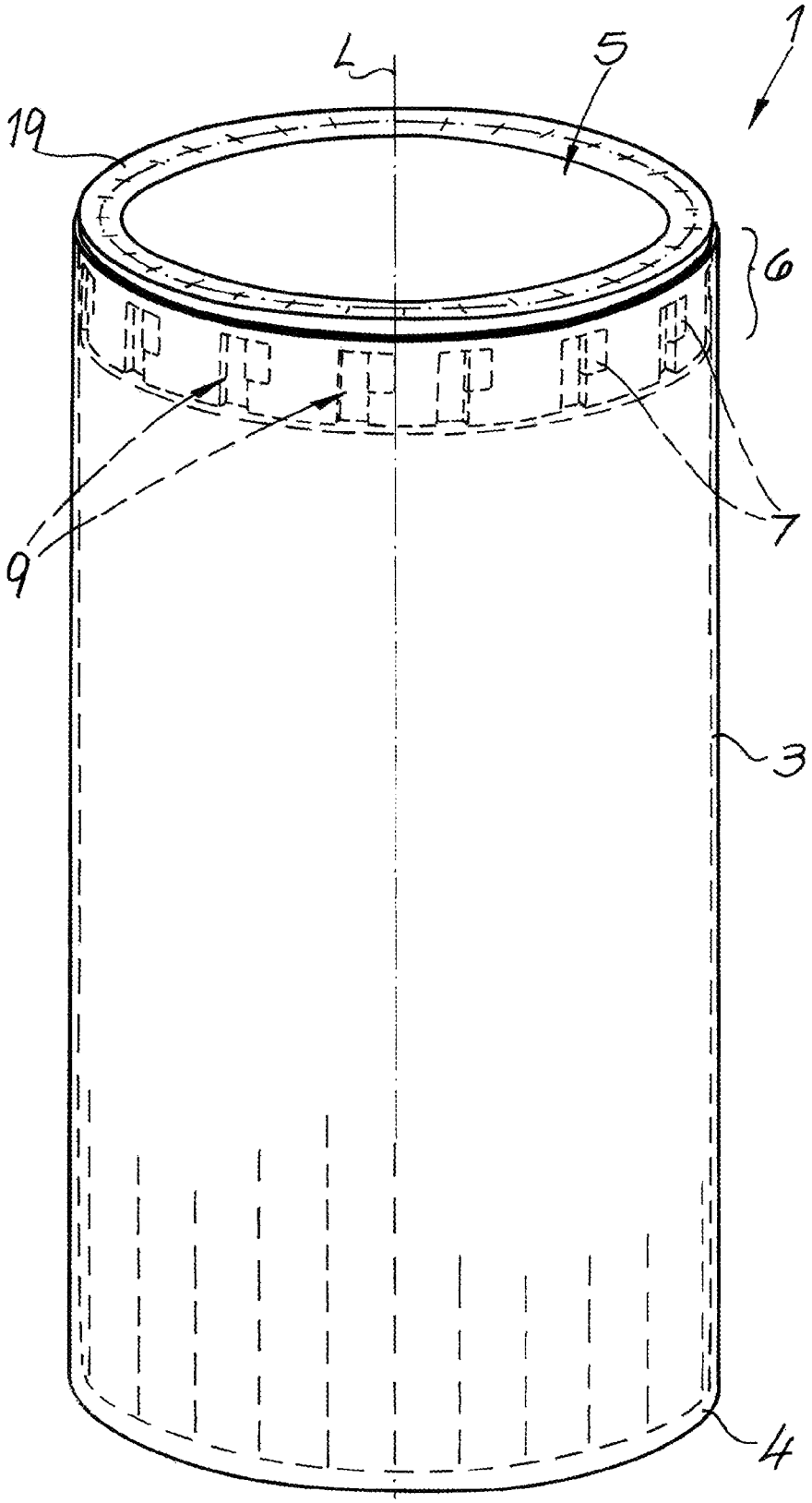
FIG. 1A is a perspective view of a container according to the invention.
Figure 1B:
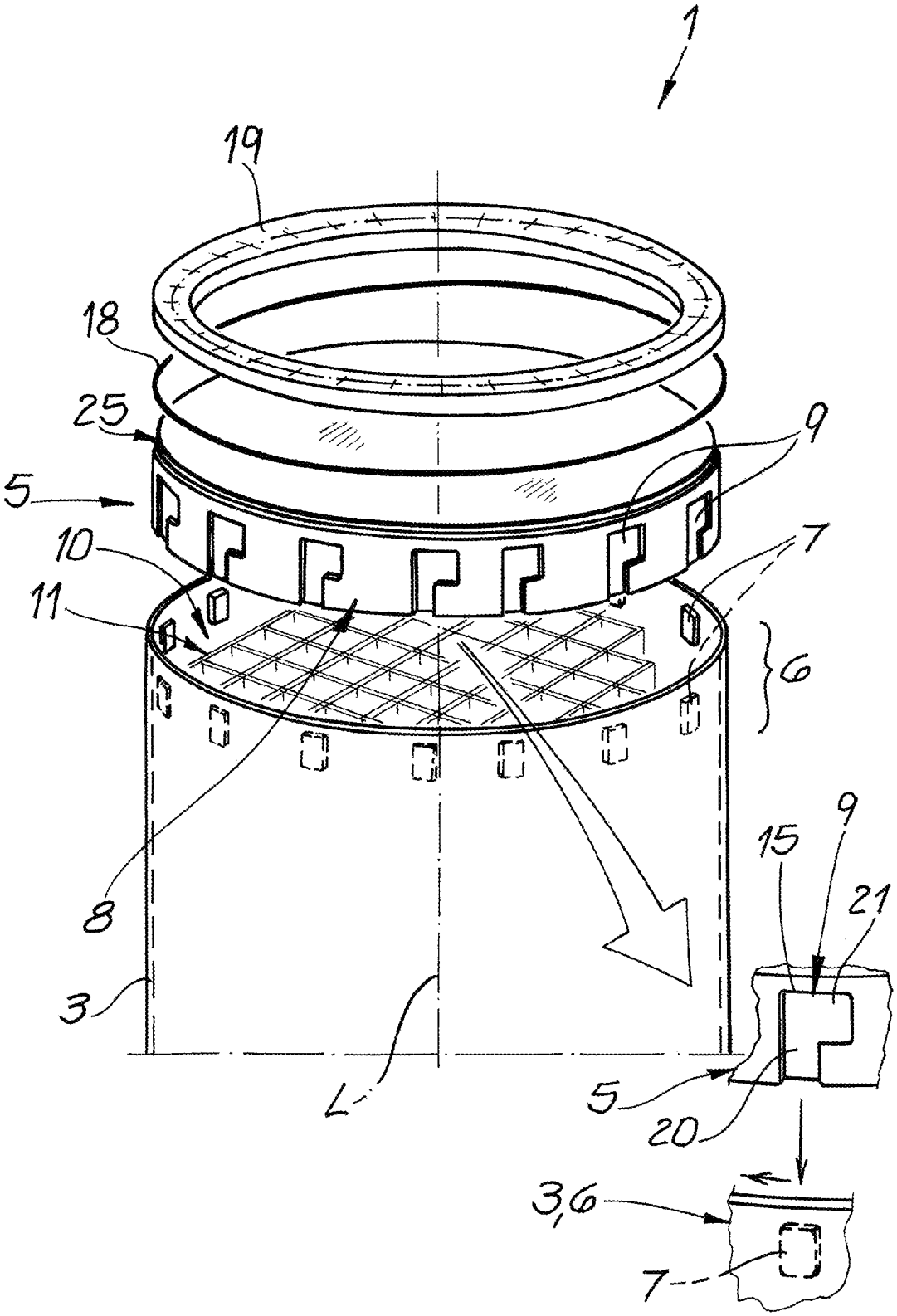
FIG. 1B is a partial perspective exploded view like FIG. 1A.
Figure 2:
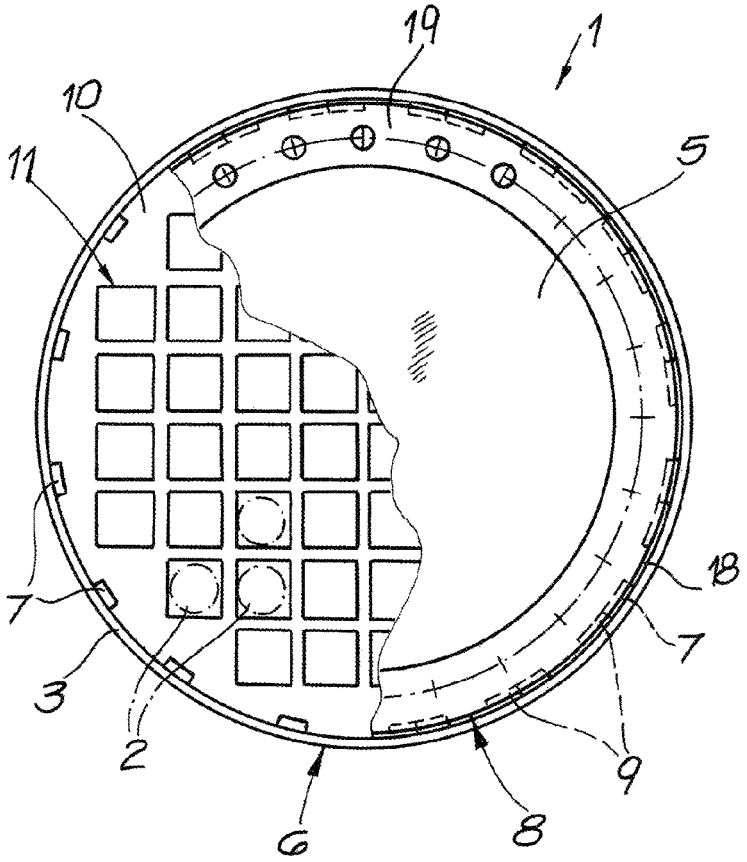
FIG. 2 is a top partly sectional view through the container according to the invention in the locking position.

As seen in drawing, a container 1 according to the invention for holding radioactive waste, in this embodiment for holding spent fuel elements 2, has a cylindrically tubular side wall 3, a flat planar floor 4 connected to a lower edge of the side wall 3, and a cover 5 sealing the open upper end of the side wall 3. The side wall 3 is centered on a normally upright axis L, and the floor 4 and cover 5 are axially spaced and extend perpendicular to the axis L. In this embodiment a support basket 11 for holding the spent fuel elements 2 is provided in the interior 10 of the container 1. The floor 4 and the side wall 3 may be unitarily connected to one another.

According to the invention, the side wall 3 has an annular array of formations 7 inside the container in its upper cover-side edge region 6 that are distributed around the inner surface of the side wall 3, and the cover 5 is provided on its outer edge with a complementary array of radially outwardly directed formations 9 that are angularly uniformly distributed around its outer edge. In the locking position of the container 1, the cover 5 is fixedly attached to the side wall 3 due to the interfitting of the cover-edge formations 9 with the formations 7 of the side wall 3. According to the invention, however, the connection between cover 5 and side wall 3 is free of welds.

A plurality of the side-wall formations 7, in this embodiment at least twelve side-wall formations 7, are arrayed around the inner surface of the side wall 3. An identical plurality of complementary cover-edge formations 9, at least twelve complementary cover-edge formations 9, are arrayed around the inner periphery of the cover 5. In this embodiment the side-wall formations 7 that are inside the container on the inner surface of the side wall 3 project radially inward, and are rectangular when viewed from above and from radially inside. The complementary cover-edge formations 9 that are distributed on the outer edge 8 of the cover 5 around the outer surface thereof are L-shaped grooves that each have a portion 20 extending parallel to a longitudinal axis L of the container as well as a portion 21 perpendicular thereto or perpendicular to the longitudinal axis L of the container. These portions 21 extend tangentially on the outer edge of the cover 5. The portions 20 parallel to the longitudinal axis L of the container open downward on the edge of the cover 5, so that the formations/projections 7 can be inserted upward into them.

In order to move the container 1, more particularly the cover 5, from an opening position to the locking position, the projections 7 of the side wall 3 engage in the formations/grooves 9 of the cover 5. Advantageously, the cover 5 is first fitted into the upper end of the side wall 3 so that the projections 7 engage axially upward into the vertical portions 20 of the grooves 9 until the projections 7 abut downwardly facing upper edges 15 of the portions 21 of the grooves 9. The cover 5 is then rotated relative to the side wall 3 so that the projections 7 are trapped in the groove portions 21 that extend perpendicular to the longitudinal axis L of the container. In this position, the projections 7 abut against the groove abutment edges 15 on the upper side of the container, so that the cover 5 is held captive on the container 1 axially of the container 1. Since the angular depth of the tangential groove portions 21 past the downwardly open vertical groove portions 20 is roughly equal to the angular dimension of the rectangular projections/formations 7, there is considerable load-bearing capacity.

Figure 3:
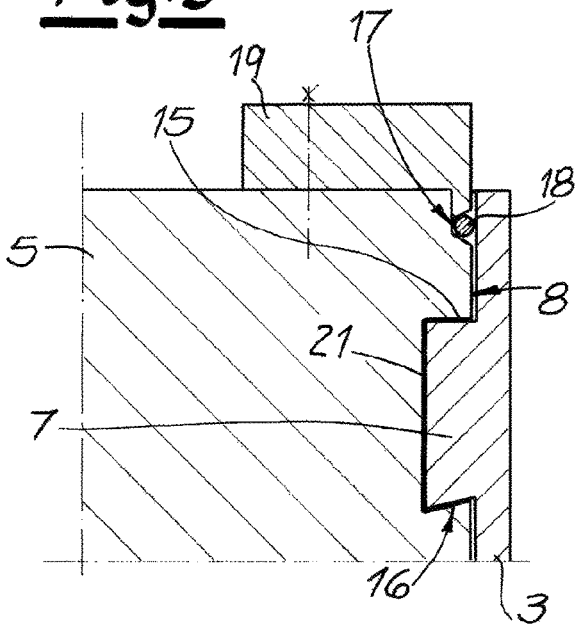
FIG. 3 is a sectional side elevational view of the container.

Especially in this embodiment as shown in FIG. 3 the portions 21 of the grooves 9 have upwardly directed lower faces 16 that are angled downward toward the interior 10 of the container and the floor 4. It lies within the scope of the invention for the projections 7 to have complementarily angled lower faces. Each of the projections 7 also has a complementarily angled face. The engagement of the projections 7 in the groove portions 21 prevents the side wall 3 from spreading as a result of loads during vertical handling of the container 1. In fact an upwardly directed vertical force applied to the cover 5 will pull in the upper edge of the side wall 3.

Figure 4:
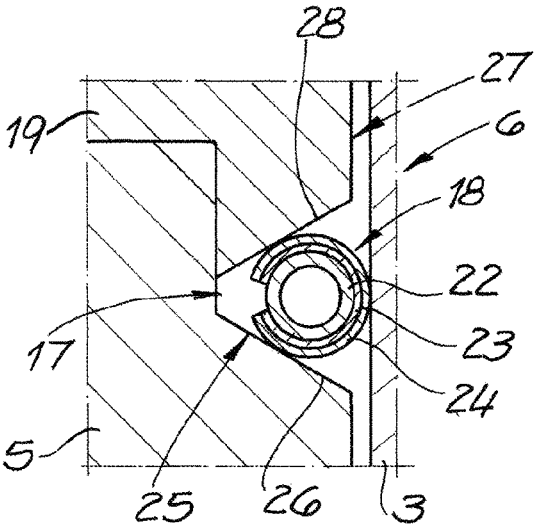
FIG. 4 is a cross-section through a seal for the container according to the invention.

It can be seen particularly in FIGS. 3 and 4 that a sealing groove 17 runs around the periphery of the container 1 on the upper end of the container 1 between the cover 5 and the upper edge of the container 3 when the container 1 is in the locking position. The cover 5 has an annular upwardly open recess 25 that runs around its edge, more particularly where its outer edge and upper surface meet to form this sealing groove 17. At least one seal 18 is in the sealing groove 17, in this embodiment is a seal ring or O-ring. Advantageously, this seal 18 is a metal gasket. In this embodiment this recess 17 of the cover 5 has a frustoconical and upwardly directed lower face 26 angled downward and outward toward the side wall 3. The seal 18, more particularly the sealing ring, advantageously rests against this base face 26.

A compression ring 19 sits on top of the cover 5 when the container 1 is in the locking position to compresses the seal 18 in the groove 17. The compression ring 19 is fixed to the cover 5 by screws. It also lies within the scope of the invention for the compression ring 19 extends around the edge of the container 1 and the cover 5. The compression ring 19 has a downwardly projecting annular ridge 27 on its outer edge that advantageously comes into direct contact with the seal 18. In this embodiment, this annular ridge 27 of the compression ring 19 has a frustoconical lower face 28 on its underside that is angled upward and outward toward the side wall 3, oppositely to the groove face 26. By virtue of this arrangement, an effective compression of the seal 18 takes place and an optimal radial sealing is achieved because the seal 18 is compressed axially by the faces 26 and 28 and forced radially outward into good contact with the inner face of the side wall 3. It is also recommended means be provided between the compression ring 19 and the side wall 3 advantageously in the form of fitted keys or wedges or similar elements not shown in the figures that fit into complementary grooves of the compression ring 19 on the one hand and of the side wall 3 on the other hand. This means prevents rotation of the ring 19 relative to the cover 5 and/or side wall 3.

FIG. 4 shows the seal 18 used according to a preferred embodiment that here is a metal gasket. This metal gasket has a core ring 22 made of at least one metal, a nickel alloy or a nickel-based alloy. Alternately, the seal 18 has a tubular inner jacket 23 that consists at least substantially of stainless steel as well as a tubular outer jacket 24 that in this embodiment consists or substantially consists of aluminum. This outer jacket 24 could also be a coating of a noble metal such as silver or gold.

We claim:

1. A container for holding radioactive waste, the container comprising:

a side wall;

a floor connected to a lower end of the side wall;

a cover;

a set of side-wall formations at an upper end of the side wall and on an inner surface of the side wall; and a set of cover-edge formations distributed around an outer edge of the cover and fittable with the side-wall formations such that, as a result of the interfitting of cover-edge formations with the side-wall formations, the formations of one of the sets being L-shaped radially open grooves that each have two portions extending perpendicular or substantially perpendicular to one another such that the cover can be or is fixedly connected to the side wall without welds.

2. The container defined in claim 1, further comprising:

a support basket inside the container for holding spent fuel elements constituting the radioactive waste.

3. The container defined in claim 1, wherein the floor and the side wall are integrally connected to one another.

4. The container defined in claim 1, wherein there are at least three of the side-wall formations distributed around the inner surface of the side wall.

5. The container defined in claim 1, wherein there are at least three cover-edge formations distributed around the outer edge of the cover.

6. The container defined in claim 1, wherein the formations of the other of the sets are radial projections fittable in the grooves.

7. The container defined in claim 1, wherein the side wall is substantially cylindrical and centered on an axis, one of the portions of each groove extending tangentially and the other of the portions of each groove extending axially.

8. The container defined in claim 7, wherein, in a locking position with the cover axially secured by the formations to the side wall, the formations of the other set each bear upward on a downwardly directed upper face of the one portion of the respective groove.

9. The container defined in claim 8, wherein an upwardly directed lower face of each of the other portions of each groove is angled downward and toward the floor, and lower downwardly directed faces of the formations of the other set are complementarily angled, whereby an upward force on the cover pulls the upper edge of the side wall radially inward.

10. The container defined in claim 1, wherein the cover and side wall form an upwardly open sealing groove, the container further comprising:

an annular seal fitted in the groove.

11. The container defined in claim 10, wherein the seal is a metal or elastomeric seal.

12. The container defined in claim 10, further comprising:

a compression ring releasably secured atop the cover and formed with an axially downwardly projecting ridge engaging in the groove and pressing the seal against an upper face of the sealing groove and the inner surface of the side wall.

13. The container defined in claim 12, wherein the ridge has a frustoconical lower face facing radially outward and downward and the sealing groove has a frustoconical upper face facing radially outward and upward, whereby the ridge presses the seal radially outward against the inner surface of the side wall when axially squeezing the seal between the lower and upper faces.

14. The container defined in claim 1, wherein the container is a transport or storage container, the cover is a primary cover of the transport or storage container, the container further comprising:

a secondary cover fixed to the container above the primary cover seals.

15. A container assembly, comprising a container according to claim 14, wherein the container is a canister loaded with spent fuel elements and received in a transport or storage container that can be or is sealed with the secondary cover over the primary cover.

* * * * *